US005570487A

United States Patent [19]

Schneider

[11] Patent Number: 5,570,487

[45] Date of Patent: Nov. 5, 1996

[54] TOOTHBRUSH HAVING MULTIPLE BRUSHING SURFACE CONFIGURATIONS

[76] Inventor: Bernard S. Schneider, 7031 Aracoma Dr., Cincinnati, Ohio 45237

[21] Appl. No.: 557,360

[22] Filed: Nov. 13, 1995

[51] Int. Cl.[6] ..... A46B 9/04

[52] U.S. Cl. ..... 15/167.1; 15/DIG. 5

[58] Field of Search ..... 15/110, 159.1, 15/160, 167.1, 167.2, DIG. 5

[56] References Cited

U.S. PATENT DOCUMENTS

| | | | |
|---|---|---|---|
| 43,597 | 7/1864 | Nelson . | |
| D. 77,115 | 12/1928 | Mowry . | |
| D. 175,894 | 10/1955 | Krueger . | |
| 1,118,156 | 11/1914 | Schoepe . | |
| 1,892,867 | 1/1933 | Burr . | |
| 2,084,873 | 6/1937 | Strause . | |
| 2,290,454 | 7/1942 | Steinberg . | |
| 2,603,806 | 7/1952 | Kisky . | |
| 3,010,131 | 11/1961 | Kisky . | |
| 5,305,489 | 4/1994 | Lage | 15/DIG. 5 |
| 5,392,483 | 2/1995 | Heinzelman et al. | 15/DIG. 5 |

FOREIGN PATENT DOCUMENTS

| | | |
|---|---|---|
| 169650 | 8/1934 | Switzerland . |
| 4365 | 3/1895 | United Kingdom . |

*Primary Examiner*—David Scherbel
*Assistant Examiner*—Randall E. Chin
*Attorney, Agent, or Firm*—Porter, Wright Morris & Arthur

[57] ABSTRACT

A shaft is formed with a curved neck. The long axis of an oval brash head at the end of the neck is approximately perpendicular to a handle region of the shaft. Four semi-circular rows of bristles and two relatively straight rows of bristles project from the brush head at approximately right angles to the handle region. Two of the semi-circular rows are proximal to the handle and define a generally convex brushing surface. The other two semi-circular rows are distal to the handle and define a generally concave brushing surface. The two relatively straight rows are medial to the concave and convex brushing surfaces and define a generally planar brushing surface.

10 Claims, 2 Drawing Sheets

TOOTHBRUSH HAVING MULTIPLE BRUSHING SURFACE CONFIGURATIONS

BACKGROUND OF THE INVENTION

The present invention relates to toothbrushes and more particularly to the configurations of the bristle, head and handle portions thereof.

Most hand operated toothbrushes are crafted with the brush head substantially aligned with the handle, in a generally I-shaped configuration. Many years ago, the dental profession generally did not know as much about the treatment of gum disease as it knew about treating tooth decay. At the time, the I-shaped toothbrush was deemed to be adquate for preventing or reducing tooth decay. This brush was designed to facilitate the movement of the brushhead horizontally over the teeth with little or no wrist involvement. However, it was discovered that this brushing pattern tended to force food and debris between the teeth and/or to cause gum erosion. In lieu of changing the conventional I-shaped brush design, it was recommended that the user manipulate the brush head in a generally rotary fashion with ample wrist movement. For many users, however, it is difficult to accomplish effective rotary movements with an I-shaped toothbrush, especially on the inner surfaces of the teeth and particularly for children. Furthermore, it is believed that the I configuration permits the user to apply excessive force, thereby causing abrasion of the teeth and gums. In addition, effective brushing with an I-shaped brush can become tedious and time consuming.

Over the past century, several toothbrushes were designed with the brush head disposed perpendicularly to the long axis of the head to form a T-shaped configuration. U.S. Pat. Nos. Des. 77,115, Des. 175,894 and 1,118,156 illustrate such T-shaped toothbrushes. These brushes were, in theory, conducive to relatively simple and gentle up-and-down brush strokes that would be easy for children to learn and that would effectively remove plaque and other deposits from the interproximal surfaces between the teeth, as well as from the areas of the teeth closest to the gums. In reality, however, there were several problems associated with the T-shaped toothbrush. Some of the brush heads were too wide to reach the inner surfaces of the lower front teeth, where the dental arches are particularly acute. The heads of these early T-shaped brushes and/or the bristle arrays provided thereon were planar concave, or convex. The concave shape impaired the bristles from effectively brushing the inner surfaces of the front teeth. The convex shape impaired the bristles from effectively brushing the outer surfaces of the front teeth, and the planar shape impaired the bristles from effectively brushing either surface of the front teeth. In addition, the straight handle and neck configuration on many of the old T-shaped toothbrushes forced the user to frequently adjust the angle at which the brush was held in the mouth to avoid hitting the chin and other parts of the face during brushing. Furthermore, many of the brush handles were formed with relatively wide flat surfaces, thereby impeding the user's ability to turn the brush in his or her hand. Finally, many of the handles were too short to facilitate brushing of the tongue, the roof of the mouth and the gums behind the last molar teeth. The importance of brushing these toothless areas of the mouth has received some attention relatively recently as knowledge of diseases of the oral cavity has increased. Thus, while the T-shaped toothbrush was, at least in principle, superior in many respects to the I-shaped brush, the foregoing drawbacks, it is believed, virtually eliminated the T-shape from the marketplace.

SUMMARY AND OBJECTS OF THE INVENTION

A toothbrush according to the present invention basically comprises an elongated shaft having a handle region and a neck region offset from the handle region, a brush head projecting from the neck region in approximately perpendicular relation to the handle region, and a plurality of bristles mounted on the brush head and arranged in a plurality of rows. At least one of the bristle rows defines a generally convex brushing surface, at least one other of the bristle rows defines a generally planar brushing surface and at least one of another of the bristle rows defines a generally concave brushing surface. Preferably, the bristle rows defining the convex brushing surface are relatively proximal to the handle region, the bristle rows defining the generally planar brushing surface are relatively medial to the concave and convex brushing surfaces and the bristle rows defining the generally concave brushing surface are relatively distal to the handle region.

Primary objects of the present invention are to provide a toothbrush which effectively removes food particles and other detritus, which facilitates the use of a relatively simple brush stroke pattern, which tends to reduce the amount of gum erosion or abrasion associated with and the amount of time required for the brushing routine, and which is cost effective to manufacture.

DETAILED DESCRIPTION OF THE PREFERRED EMBODIMENT

Figure 1:
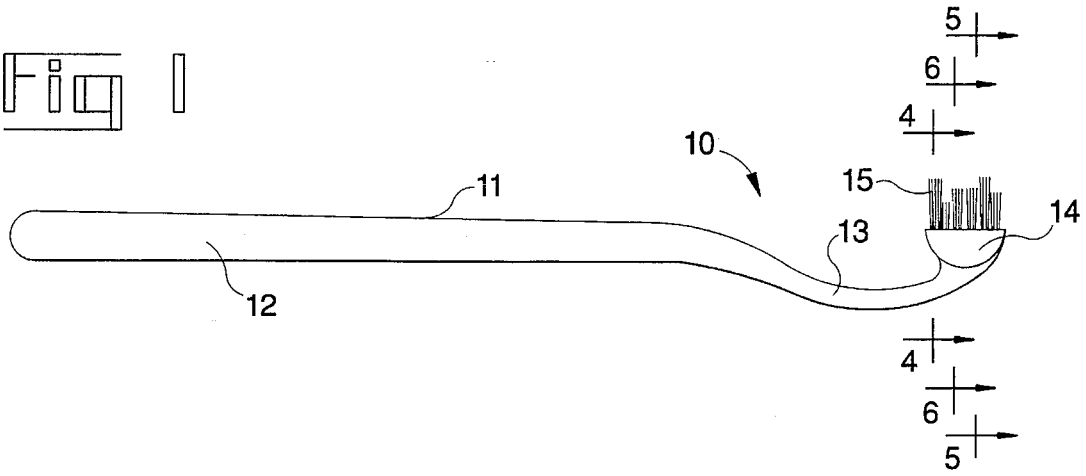
FIG. 1 is a side elevational view of a toothbrush according to the present invention.

As illustrated in FIG. 1, a toothbrush, generally designated 10, according to the present invention basically comprises an elongated shaft 11 formed with a handle region 12 and with a neck region 13, a brush head 14 projecting from the neck region and a plurality bristles 15 mounted on the brush head. Preferably, the overall length of a large-sized toothbrush 10 is between 6.5 and 7 inches. Medium and small sizes of the present brush 10 are provided with shorter shafts 11 and smaller brush heads 14, as described below. The shaft 11 is generally circular in cross sectional configuration and is thicker in the handle region 12 than in the neck region 13. The handle portion 12 may be circular, octagonal or hexagonal in cross sectional configuration. In this manner, the user can rotate the present toothbrush 10 in her hand more easily than a toothbrush formed with relatively wide flat surfaces on opposite sides. The neck region 13 is offset from the handle region 12, preferably in a curved configuration, so that interference between the neck 13 and the jaw or chin of the user can be avoided without altering the brushing pattern described below. The curvature of the neck region 13 and the orientation of the brush head 14 thereon are such that the bristles 15 project from the head 14 at approximately right angles to the long axis of the handle region 12. Preferably, the handle region 12 is approximately twice the length of the neck region 13. The handle 12, the neck 13, the brush head 14 and the bristles 15 are formed from synthetic resin materials well known in the toothbrush art, and the bristles are secured to the head in a conventional fashion. Relatively fine bristles should be used.

Figure 2:
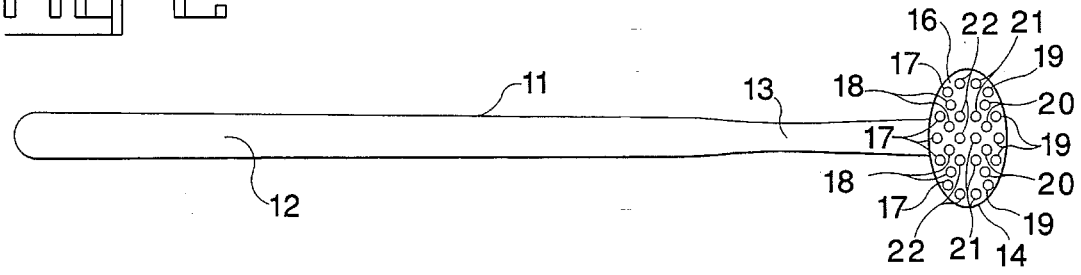
FIG. 2 is a front elevational view of the present toothbrush.

As illustrated in FIG. 2, the brush head 14 is formed with an oval bristle-bearing surface 16 whose long axis is approximately perpendicular to the long axis of the shaft 11. The bristles 15 projecting from the oval surface 16 are arranged in six rows 17–22, four of which are generally semi-circular and two of which are generally straight. Two of the semi-circular rows 17, 18 are relatively proximal to the handle portion 12 and the other two semi-circular rows 19, 20 are relatively distal to the handle portion. The two generally straight rows 21, 22 are relatively medial to the rows 17,18 and rows 19,20. Preferably, the longer dimension of the oval-bristle bearing surface 16 on the large-sized brush 10 is between ⅞ inch and 1¼ inches. Smaller brush heads bearing fewer rows of bristles would be available on medium and small sized brushes for children and for those users whose dental arches are relatively small or angular. It is also contemplated that the brush head could be rectangular, in which case all of the bristle rows would be generally straight.

Figure 3:
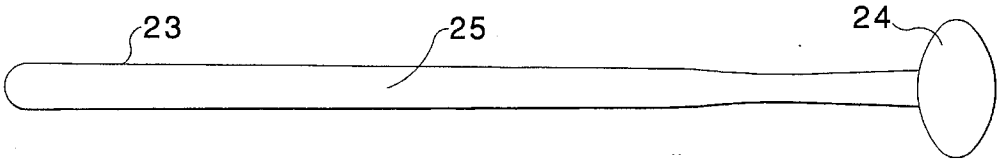
FIG. 3 is a front elevational view of a template suitable for selecting the proper brush head size.

As illustrated in FIG. 3, a plurality of thin, planar and disposable templates 23 are provided to assist the user in selecting the toothbrush 10 in the proper size.. The head 24 of the template 23 corresponds in size and shape to the bristle-receiving surface 16 and the length of the stem 25 corresponds to the length of the shaft 11 on a particular size of the present toothbrush 10. It is contemplated that a plurality of individually wrapped, differently sized templates corresponding to the various sizes of the toothbrush would be available to the user at the point of purchase. The user would unwrap one or more of the templates 23, and place the head 24 of one or more templates 23 against the inner or lingual surfaces of the lower incisors to determine the brush head size which is the most suitable. The user would then position the template head 24 at or slightly behind one of the last molars to gauge the appropriate shaft length.

Figure 4:
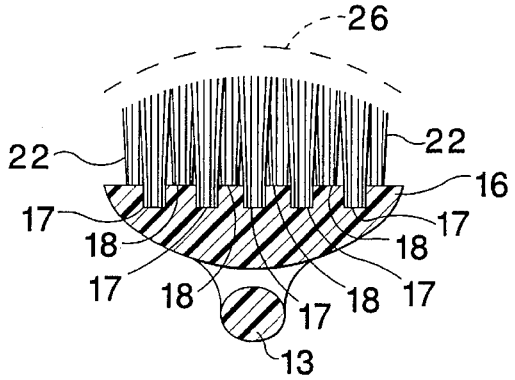
FIG. 4 is a sectional view taken along line 4—4 of FIG. 1 and particularly illustrates the generally convex brushing surface on the proximal rows of bristles.

As illustrated in FIG. 4, the proximal bristle rows 17, 18 collectively define a generally convex brushing surface 26. The curvature of the convex brushing surface 26 approximates the curvature of the teeth and gums on the interior or lingual sides of the upper and lower incisors and cuspids or canines.

Figure 5:
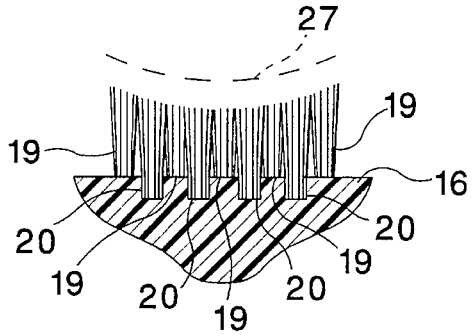
FIG. 5 is a sectional view taken along line 5—5 of FIG. 1 and particularly illustrates the generally planar brushing surface on the medial rows of bristles.

As illustrated in FIG. 5, the distal bristle rows 19, 20 collectively define a generally concave brushing surface 27. The curvature of the concave brushing surface 27 approximates the curvature of the teeth and gums on the outer or labial sides of the upper and lower incisors and cuspids or canines.

Figure 6:
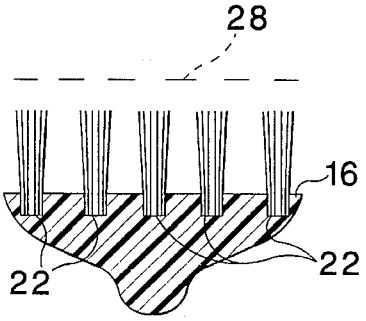
FIG. 6 is a sectional view taken along line 6—6 of FIG. 1 and particularly illustrates the generally concave brushing surface on the distal rows of bristles.

As illustrated in FIG. 6, the medial bristle rows 21, 22 collectively define a generally planar brushing surface 28. The curvature of the planar brushing surface 28 approximates the curvature of the teeth and gums on the inner and outer surfaces of the upper and lower molars.

The present toothbrush 10 is used in the following manner. The user grasps the handle region 12 and, while holding the shaft 11 in approximately a vertical position, positions the brushing surface 27 on the outer or labial side of the gums below the four lower incisor teeth. The handle region 12 may be tilted outwardly from the user's chin approximately thirty degrees to increase the amount of contact between the generally concave brushing surface 27 on the distal rows 19, 20 of the brush head and the generally convex configuration of the teeth and gums in this area of the mouth. However, it is advantageous to limit the angle of the shaft 11 away from the vertical plane so that a substantial amount of contact is maintained between this area of the mouth and the generally planar brushing surface 28 on the medial bristle rows 21, 22 and 17, 18, respectively. With the jaw closed and the upper and lower teeth in normal biting contact with one another, the user brushes upwardly over the lower gums and incisors and over the upper incisors and gums. The user then brushes downwardly over the same area and repeats the foregoing up and down brush stroke approximately ten times in this location. Substantially the same up and down brush stroke is applied to the outer or labial surfaces of the teeth and gums in the cuspid or canine areas on opposite sides of the mouth, and to the outer or buccal surfaces of the teeth and gums in the bicuspid and molar areas on opposite sides of the mouth, with ten strokes in each area. Preferably, the user adjusts the angle of the shaft 11 closer to a vertical orientation while brushing the molar areas. In this manner, contact between the generally planar molar areas and the generally planar brushing surface 28 on the medial rows 21, 22 is increased.

The user then rotates the toothbrush 10 approximately one-hundred and eighty degrees and places the convex brushing surface 26 on the gum tissue above the upper incisors on the inner or lingual side of the mouth at an angle of about forty-five degrees from a vertical plane. The handle region 12 is tilted slightly away from the chin to maximize the amount of contact between the generally concave configuration of the teeth and gums on the lingual side and the generally convex brushing surface 26 of the proximal bristle rows 17, 18. Since the shaft 11 must extend between the upper and lower teeth in order to brush the inner surfaces thereof, the brush stroke is shorter and is limited to either the upper or lower portions of the mouth. The user pulls the brush head downwardly along the lingual surfaces of the gums and upper incisors. Then, without lifting the brush head from the teeth, the user pushes the brush head upwardly over the same area and repeats this up and down motion approximately ten times before shifting the brush laterally to the cuspid or canine areas on opposite sides of the incisors. Substantially the same relatively short up and down brush stroke is applied to the lingual surfaces of the upper teeth and gums in the cuspid, bicuspid and molar regions. However, it is advantageous to reduce the angularity of the shaft 11 while brushing the interior molar regions in order to increase the amount of contact between the generally planar brushing surface 28 on the medial bristle rows 21, 22 and the generally planar configuration of the teeth and gums in this area.

In order to brush the interior or lingual surfaces of the lower teeth and gums, the user turns the toothbrush 10 upside down and positions the convex brushing surface 26 on the gums below the lower incisors. The shaft 11 is held at an angle that provides the greatest amount of contact between the generally concave configuration on the lingual side of the lower teeth and gums and the generally convex brushing surface 26 on the proximal bristle rows 17, 18 while providing substantial contact between these areas of the mouth and the other brushing surfaces 27, 28. The user draws the toothbrush 10 upwardly from the gums to the tips of the lower incisors and back down again over the same area. Preferably, this up and down stroke is repeated ten times, whereupon the user shifts the toothbrush 10 laterally to brush the lingual surfaces of the lower teeth and gums in the cuspid, bicuspid and molar regions. The angularity of the shaft 11 is adjusted when brushing the interior surfaces in the molar regions in such a manner that contact between the generally planar surfaces in the molar regions and the generally planar brushing surface 28 on the medial bristle rows 21, 22 is increased.

The tongue, the roof of the mouth, the biting surfaces on the bicuspids and molars and the gums behind the molars are brushed by holding the shaft 11 generally horizontally, rotating the handle to point the bristles 15 towards the surface to be brushed, positioning the brushing surfaces against the selected surface and moving the present toothbrush 10 in relatively short and repetitive strokes towards and away from the back of the throat. Advantageously, the toothbrush 10 is of sufficient length to conveniently and effectively brush these interior areas.

Thus, the present invention provides a toothbrush that is designed to effectively remove food particles and other detritus from the teeth, gums and other parts of the mouth, to accomplish the foregoing with relatively simple brush strokes, to minimize gum abrasion and erosion attributable to the brushing process and to be cost effective to manufacture.

While a single preferred embodiment of the present toothbrush 10 has been described and illustrated in some detail, the foregoing disclosure is not intended to unduly limit or restrict the spirit of this invention or the scope of the following claims.

I claim:

1. A toothbrush comprising:

a shaft having a handle portion and a neck portion, said neck portion being connected to the handle portion and being offset from the handle portion;

a brush head projecting from the neck portion, said brush head being disposed in approximately perpendicular relation to the handle portion;

a plurality of bristles mounted on the brush head and arranged in a plurality of rows, at least one of said rows defining a generally convex brushing surface, at least one other of said rows defining a generally planar brushing surface and at least one further of said rows defining a generally concave brushing surface.

2. The toothbrush according to claim 1, wherein the generally convex brushing surface is proximal to the handle portion relative to said concave and planar brushing surfaces.

3. The toothbrush according to claim 1, wherein the generally planar brushing surface is medial to said convex and concave brushing surfaces.

4. The toothbrush according to claim 1, wherein the generally concave brushing surface is distal to the handle portion relative to said convex and planar brushing surfaces.

5. The toothbrush according to claim 1, wherein the bristles project from the brush head at approximately right angles relative to the handle portion.

6. The toothbrush according to claim 1, wherein the shaft is at least six inches long.

7. The toothbrush according to claim 1, wherein the brush head is formed with an oval bristle-bearing surface, said oval bristle-bearing surface having a longitudinal axis disposed approximately perpendicularly to the handle portion.

8. The toothbrush according to claim 7, wherein the brush head is provided with four semi-circular rows of bristles and two relatively straight rows of bristles.

9. The toothbrush according to claim 8, wherein two of the fore semi-circular rows of bristles are proximal to the handle portion, another two of said four semi-circular rows are distal to the handle portion and the two relatively straight rows of bristles are medial to the concave and convex brushing surfaces.

10. The toothbrush according to claim 9, wherein said proximal rows of bristles define the generally convex brushing surface, said distal rows of bristles define the generally concave brushing surface and said medial rows of bristles define the generally planar brushing surface.

* * * * *